US008262851B2

(12) United States Patent
Aichinger et al.

(10) Patent No.: US 8,262,851 B2
(45) Date of Patent: Sep. 11, 2012

(54) PROCESSES AND SYSTEMS FOR THE PULPING OF LIGNOCELLULOSIC MATERIALS

(75) Inventors: Johann Aichinger, Pregarten (AT); Eric Xu, Fairborn, OH (US); Marc J. Sabourin, Beavercreek, OH (US)

(73) Assignee: Andritz Inc., Glens Falls, NY (US)

( * ) Notice: Subject to any disclaimer, the term of this patent is extended or adjusted under 35 U.S.C. 154(b) by 714 days.

(21) Appl. No.: 11/826,837

(22) Filed: Jul. 18, 2007

(65) Prior Publication Data

US 2008/0035286 A1 Feb. 14, 2008

Related U.S. Application Data

(60) Provisional application No. 60/836,678, filed on Aug. 10, 2006.

(51) Int. Cl.
*D21B 1/02* (2006.01)
*D21B 1/16* (2006.01)

(52) U.S. Cl. ..... 162/25; 162/24; 162/28

(58) Field of Classification Search ..... 162/78, 162/24, 25, 28

See application file for complete search history.

(56) References Cited

U.S. PATENT DOCUMENTS 3,219,282 A * 11/1965 Horstman ..... 241/38
4,311,553 A 1/1982 Akerlund et al.
4,718,980 A * 1/1988 Lowrie et al. ..... 162/78
4,756,799 A 7/1988 Bengtsson et al.
5,002,635 A 3/1991 Gentile, Jr. et al.
6,258,207 B1 * 7/2001 Pan ..... 162/27
6,458,245 B1 * 10/2002 Hoglund et al. ..... 162/149
6,770,168 B1 8/2004 Stigsson
2003/0111200 A1 * 6/2003 Prough et al. ..... 162/233
2004/0112557 A1 * 6/2004 Parrish et al. ..... 162/78
2004/0118529 A1 * 6/2004 Kamijo et al. ..... 162/25

(Continued)

FOREIGN PATENT DOCUMENTS

EP 0 138 484 4/1985

(Continued)

OTHER PUBLICATIONS

Smook, Handbook for Pulp and Paper Technologists, 1992, Angus Wilde Publications, 2nd edition, chapter 11.*
Grace ed., Mechanical Pulping, 1987, CPPA/TAPPI, vol. 2 Pulp and Paper Manufacture, p. 107-117 and p. 239-240.*
Smook, Handbook for Pulp and Paper Technologists, 1992, Angus Wilde Publications, 2nd edition, p. 122-123.*

(Continued)

*Primary Examiner* — Anthony Calandra
(74) *Attorney, Agent, or Firm* — Nixon & Vanderhye P.C.

(57) ABSTRACT

A non-compression vessel, such as a digester, is employed for the chemical preconditioning of the chips followed by a fiberizing device to break the preconditioned chips down to fiber bundles, which are then washed before a high consistency chemical treatment. The digester may be one such as used in conventional chemical pulping of wood with or without screens for the extraction of chemical. If extracted this chemical could be recirculated to the digester with treatment in the circulation loop such as heating or the addition of dilution or other chemicals. This digester may be hydraulic or vapor phase (that is contain a vapor space within the digester), and operate in either a continuous or batch fashion. This digester allows for the discharge of material without the use of a screw mechanism. The digester treated material is then defiberized to convert the chips into course fiber bundles, which then is washed and dewatered. The washed and dewatered pulp is then treated with alkali peroxide chemicals to develop brightness and other pulp properties.

8 Claims, 3 Drawing Sheets

U.S. PATENT DOCUMENTS

2004/0200586 A1 10/2004 Herkel

FOREIGN PATENT DOCUMENTS

| | | |
|---|---|---|
| EP | 0 194 981 | 9/1986 |
| WO | 2005/042830 A1 | 5/2006 |
| WO | 2007/063171 | 6/2007 |

OTHER PUBLICATIONS

Sunholm, Jan, Mechanical Pulping, 1999, Fapet Oy, book 5, p. 166-168.*

Ingruber editor, Sulfite Science and Technology, 1985, vol. 4 Third edition, p. 187-188.*

* cited by examiner

PROCESSES AND SYSTEMS FOR THE PULPING OF LIGNOCELLULOSIC MATERIALS

CROSS-REFERENCE TO RELATED APPLICATION

This application is based on and claims domestic priority benefits under 35 USC §119(e) from U.S. Provisional Application Ser. No. 60/836,678 filed on Aug. 10, 2006,the entire content of which is expressly incorporated hereinto by reference.

FIELD OF INVENTION

The disclosure below relates generally to the pulping of cellulosic materials. More specifically, the present invention relates to the conversion of lignocellulosic materials into pulp by means of chemical mechanical pulping process.

BACKGROUND OF THE INVENTION

In the pulp and paper industry, there are basically two fundamentally different processing methods for converting lignocellulosic material, being wood or nonwood, into pulp used in papermaking. One processing method is chemical pulping, which uses chemicals such sodium hydroxide, sodium sulfide, sodium sulfite or different solvents, to break down bonding between each individual fiber. The other processing method is mechanical pulping, which uses mainly mechanical means such as a pair of rotating discs commonly referred to as a refiner, or a rotating grinding stone, to separate the lignocellulosic fibers from one another. The process of using mainly mechanical means for separating lignocellulosic fibers from one another is commonly called defiberization. In some mechanical pulping processes chemicals are used before, during, and/or after the mechanical defiberization in order to modify the pulp properties and/or reduce energy consumption. Applying chemicals before and/or during refiner mechanical defiberization, is commonly referred to as Chemical Mechanical Pulping (CMP) process.

In CMP, there are three fundamentally different concepts used to produce pulp. The first of these CMP concepts is to treat the material, normally in the form of chips, with chemicals and complete the treatment, or most of it, before the refiner defiberization step. The treatment may be a high temperature cooking for an extended period of time, as in a conventional CMP process, or high temperature for a relatively short period of time, as in Chemi-Thermal Mechanical Pulping (CTMP), or relatively low temperature and long period of time as in Cold Caustic Soda (CCS), Alkali-Peroxide Mechanical Pulping (APMP), Alkali-Peroxide Pulping (APP) processes. Exemplary APMP processes are disclosed in U.S. Patent Application Publication 2004/0200586 and WO 05/042830 (the entire content of each being expressly incorporated hereinto by reference). Some of these CMP processes also use a compression device to squeeze the lignocellulosic material before the chemical application to improve the desired chemical treatment effect.

The second CMP concept is to add chemical to the chips during refiner defiberization, as proposed in U.S. Pat. Nos. 3,023,140; 3,069,309; 4,187,141; 4,311,553; 4,270,976; 5,129,987 (the entire content of each such patent being incorporated expressly hereinto by reference). This type of treatment uses the refiner not only to provide defiberization but also as a mixer for chemical distribution and reaction, although in some cases, a chip pretreatment is mentioned. The pretreatment step is only for stabilizing hydrogen peroxide ($H_2O_2$), as described in U.S. Pat. No. 4,311,553,or softening the chips as described in U.S. Pat. No. 3,069,309. In such a pretreatment step the principal chemicals, in most cases peroxide, have an effect on the development of pulp properties, such as brightness, are applied at the refiner.

The third CMP concept is to combine the chemical pretreatment (in this case referred as Preconditioning) before refiner defiberization, and chemical treatment during the refiner defiberization and fibrillization process and before the final refining step (referred to as Refiner Chemical treatment) and is referred to as P-RC, (Preconditioning, followed by Refiner Chemical treatment). In P-RC APMP pulping, two different chemical strategies had been introduced. The first is to add a significant amount of alkali peroxide chemicals immediately prior to the primary refining step, which is most suitable for atmospheric refining (e.g., as described in China Patent Number: CN ZL02814472.4,the entire content of which is incorporated fully hereinto by reference); and the second is to apply the main alkali peroxide chemicals immediately after the primary refiner, which is most suitable for pressurized refining (e.g., as described in United States Patent Application Publication US 2004/0069427 A1,the entire content of which is incorporated fully hereinto by reference).

BRIEF SUMMARY OF THE INVENTION

One embodiment of the present invention comprises a process which uses a non-compression vessel, such as a digester, for chemical preconditioning of the chips followed by a fiberizing device to break the preconditioned chips down to fiber bundles, which are then washed before a high consistency chemical treatment. For the preconditioning, rather than using compression device, such as chip presses, the present invention employs a digester to distribute the chemicals inside of the chips. The digester could be one such as used in conventional chemical pulping of wood with or without screens for the extraction of chemical. If extracted this chemical could be recirculated to the digester with treatment in the circulation loop such as heating or the addition of dilution or other chemicals. This digester could be hydraulic or vapor phase (that is contain a vapor space within the digester), and operate in either a continuous or batch fashion. This digester allows for the discharge of material without the use of a screw mechanism. The digester treated material is then defiberized to convert the chips into course fiber bundles, which then is washed and dewatered. The washed and dewatered pulp is then treated with alkali peroxide chemicals to develop brightness and other pulp properties.

According to other embodiments, an alkaline peroxide mechanical pulping process is provided which comprises (a) preconditioning a lignocellulosic chip material with chemical stabilizers in a non-compression vessel; (b) discharging the preconditioned lignocellulosic chip material to a fiberizer so as to mechanically break apart the preconditioned lignocellulosic material and obtain a fiberized lignocellulosic material; (c) washing the fiberized lignocellulosic material, and thereafter (c) treating the washed and fiberized lignocellulosic material with alkali peroxide chemicals for a time and under conditions sufficient to obtain a pulp of desired consistency therefrom. Preferably, step (c) is practiced with a high consistency refiner.

Substantially all the alkali peroxide chemicals are added immediately before the fiberized lignocellulosic material is transferred to the refiner. The fiberized lignocellulosic material may advantageously be washed with a press.

According to some embodiments, the preconditioning step (a) is practiced in a digester as a non-compression vessel. Conditions within the digester may include a pressure of between 0 to 10 bar (e.g., between 0 to 6 bar), a temperature of between 10 to 170° C. (e.g., between 30 to 120° C.), and a retention time of from between 0.1 to 7 hours (e.g., between 0.1 to 4 hours). Liquor may be added lignocellulosic chip material in the digester so as to achieve a liquor to wood ratio of between about 0.5:1 to about 5:1 (e.g., between about 1.25:1 or 1.5:1 to about 1:1).

The chemical stabilizers may comprise organic chelating reagents or inorganic compounds. Preferred organic chelating reagents include diethylene triamine pentaacetic acid, ethylene diamine tetraacetic acid, and nitriletriactic acid. Preferred inorganic chemicals may comprise silicate and $MgSO_4$.

Advantageously, the process may comprise discharging the pulp to a high consistency tower and retaining the pulp in the high consistency tower for a time and under temperature conditions sufficient to achieve a desired pulp consistency. The time and temperature conditions may be sufficient to achieve a pulp consistency of between about 15 to about 45%, more preferably, more preferably between about 12 to about 60% (e.g., between about 25 to about 30%). The temperature condition within the high consistency tower may be between about 20 to about 100° C. (e.g., between about 40 to about 100° C.). The pulp is advantageously retained within the high consistency tower for up to about 7 hours (e.g., between about 15 minutes to about 4 hours).

These and other aspects and advantages of the present invention will become more clear after careful consideration is given to the following detailed description of the preferred exemplary embodiments thereof.

BRIEF DESCRIPTION OF THE DRAWINGS

Accompanying FIGS. 1 through 3 illustrate three presently preferred embodiments in accordance with the present invention so as to apply the alkali peroxide chemicals, wherein, FIG. 1 is a schematic illustration of a system in accordance with one embodiment of the present invention;

FIG. 2 is a schematic illustration of a system in accordance with another embodiment the present invention; and FIG. 3 is a schematic illustration of a system in accordance with yet another embodiment of the present invention;

DETAILED DESCRIPTION OF THE INVENTION

Figure 1:
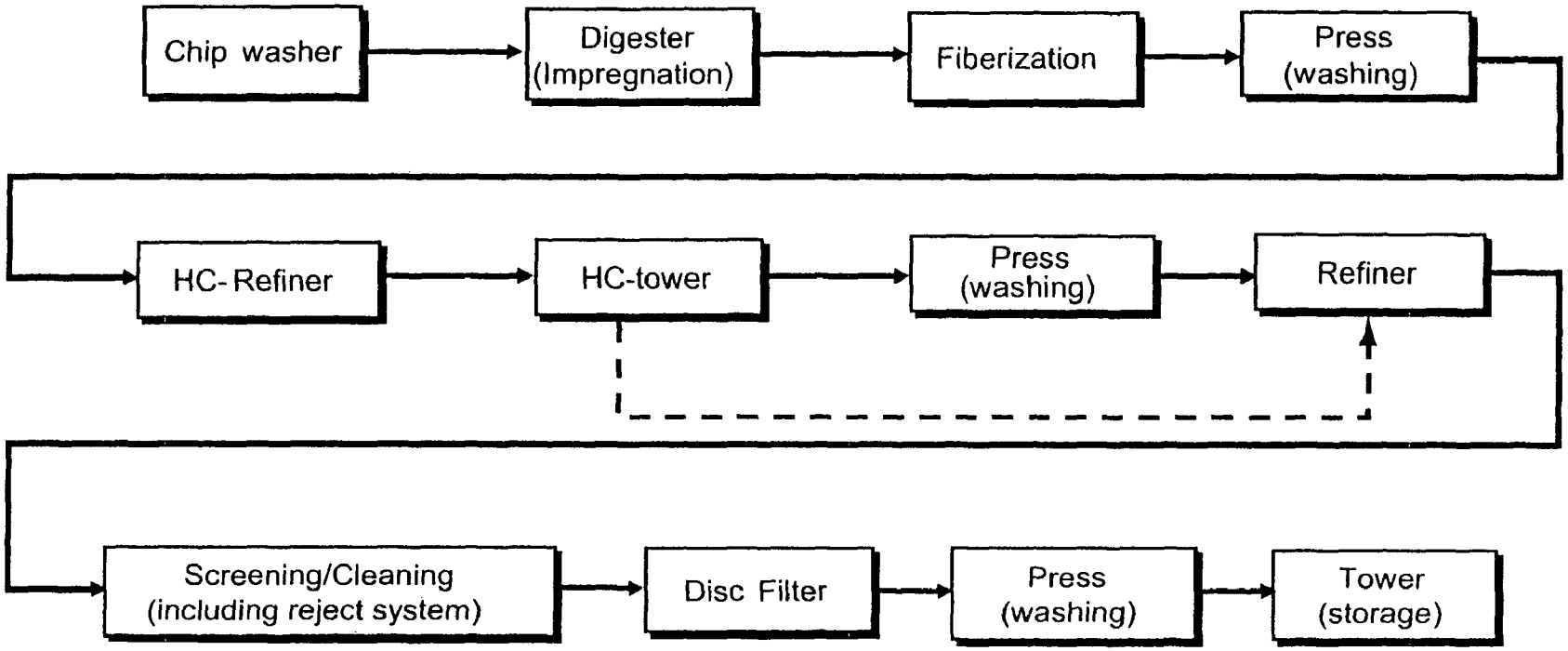

As shown in accompanying FIG. 1, chips are introduced to a chip washer, where dirt, tramp material, etc is removed from the chips in preparation for chemical addition in the digester. The process may include a chip bin before or after chip washer. The purpose of the digester is mainly to impregnate the chip with either stabilizers alone or stabilizers in combination with other chemicals traditionally used in pulp processing, such as alkali peroxide chemicals, alkaline chemicals (e.g., $Na_2CO_3$) and the like. The stabilizers include any organic chelating reagents (e.g. diethylene triamine pentaacetic acid (DTPAP), ethylene diamine tetraacetic acid (EDTA), nitriletriactic acid (NTA) and the like, or inorganic chemicals (e.g. silicate, $MgSO_4$ and the like) that reduces or stops transition metal reactivity toward peroxide chemicals. Preferably, the operation conditions for the digester are:

Pressure: 0-6 bar (preferably 3.5 bar)

Temperature: 30-120° C. (preferably 40-90° C.)

Time: 0.1-4 hours (preferably 1 hour)

Liquor to Wood ratio: 1.5:1 (preferably 2.5:1)

Liquor may be added to the digester to obtain the desired liquor to wood ratio. This liquor may be stabilizer dissolved in water with or without alkali and with or without peroxide. The fiberizer after the digester is designed to gently break the impregnated chips into fiber bundles so that the material can be easily washed with conventional washing equipment and be easily fed to a conventional high consistency refiner. Most or all the alkali peroxide chemicals are added either immediately before the refiner and/or a blow line immediately after the refiner. The chemical-mixed material (pulp) is then retained in a high consistency tower to allow the chemical reactions to complete. The treated pulp is then, with or without washing, refined using either a high, medium, or low consistency refiner, with at least one stage of refining, which may be one or more refiners run at the same consistency or a combination of refiners run at different consistencies. The refined pulp undergoes treatments as is conventional in mechanical pulping processes, such as latency removal, screening, cleaning, screen reject treatment, washing/dewatering, and the like.

The high consistency refiner performs both further defiberization and fibrillation as a conventional primary mechanical pulp system (e.g. either thermal mechanical pulping (TMP) or refiner mechanical pulping (RMP)), and mixing alkali peroxide chemicals either at the refiner or in the blow line after the refiner. The alkali chemicals include alkali and peroxide in various forms, and with or without peroxide stabilizers. Quantities of the chemicals used vary, and depend on the nature of the raw material and the product.

The high consistency tower is mainly to give the added chemicals enough reaction time to complete their reactions. The pulp consistency can be between about 12 to about 60% (e.g., between about 15 to about 45%, preferably between about 25 to about 30%), and the temperature can be between about 20 to about 100° C (e.g., between about 40 to about 100° C., preferably between about 70 to about 95° C.). The retention time may varies a few minutes to several hours (e.g., up to 7 hours), for example from about 15 minutes to about 4 hours, depending on the raw materials and the products.

After the high consistency tower, the pulp can either be washed with a pulp press first, or is refined using at least one of a high, medium, or low consistency refiner, with at least one stage of refining, which may be one or more refiners run at the same consistency or a combination of refiners run at different consistencies with or without a latency chest in between. The washed and dewatered (pressed) pulp can be refined using either high or low or medium consistency refiner.

After the main line refining, the pulp goes through normal pulping process stages, e.g. screening, cleaning (if necessary), thickening and washing, and final storage.

Figure 2:
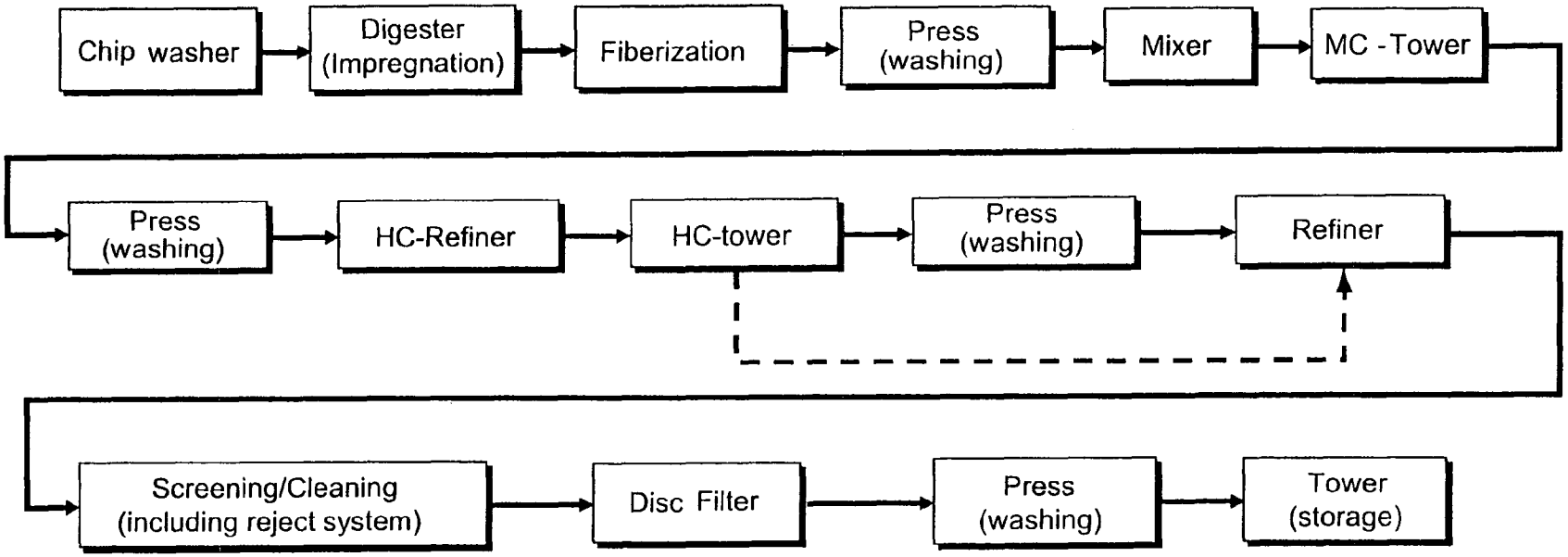

Another embodiment of the process system according to the present invention is depicted in FIG. 2. As can be seen, the process system depicted in FIG. 2 is similar to that depicted in FIG. 1, except that it has a medium consistency (8-15%) chemical treatment between fiberization refiner and high consistency refiner. The embodiment of FIG. 2 is mainly for the situation where a more aggressive chemical treatment than 1-stage high consistency treatment, is needed. The medium consistency tower utilizes recovered chemical residuals from the high consistency tower, together with some make-up alkali peroxide chemicals if necessary.

Figure 3:
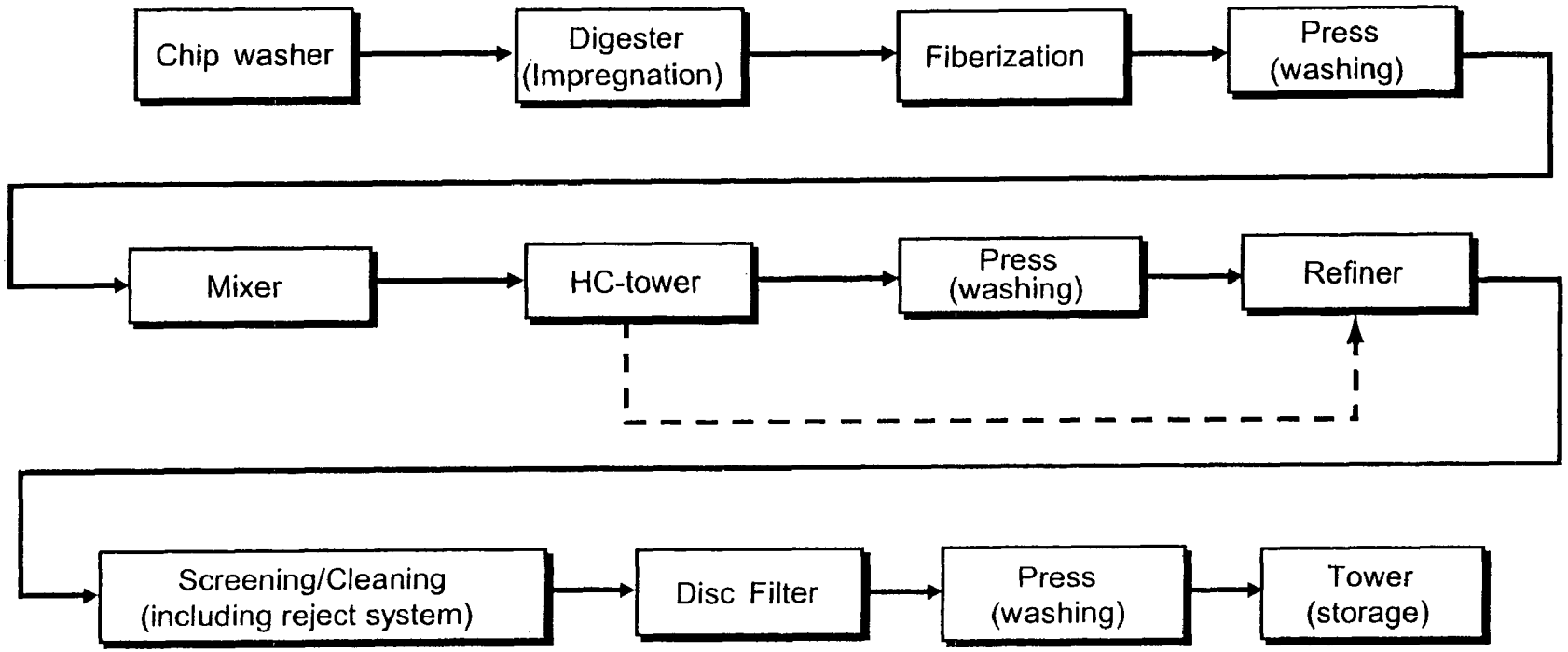

The process system depicted in FIG. 3 is also similar to the embodiment depicted in FIG. 1, except that a mixer, rather than a refiner, is used for adding the alkali peroxide chemicals for the high consistency chemical treatment. The mixer can be either of disc refiner type or other designs. The treated pulp was then, with or without washing, refined using either high, or medium, or low consistency refiner, with either one or multiple stages of refining which may be a combination of refiners run at different consistencies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An alkaline peroxide mechanical pulping process comprising the steps of:

(a) preconditioning a lignocellulosic chip material by adding chemical stabilizers selected from the group consisting of diethylene triamine pentaacetic acid (DTPA), ethylene diamine tetraacetic acid (EDTA), nitrilotriacetic acid (NTA), silicate and $MgSO_4$ to a non-compressive digester containing the lignocellulosic chip material to be preconditioned in the presence of liquor to achieve a liquor to wood ratio in the digester of between about 0.5:1 to about 5:1 to form a preconditioned liqnocellulosic chip material;

(b) discharging the preconditioned lignocellulosic chip material from the digester without the use of a screw mechanism to a fiberizer, and mechanically breaking apart the preconditioned lignocellulosic material in the fiberizer to obtain a fiberized lignocellulosic material;

(c) washing the fiberized lignocellulosic material, (d) feeding the washed fiberized lignocellulosic material to a high consistency refiner;

(e) treating the washed and fiberized lignocellulosic material with alkali peroxide chemicals for a time and under conditions sufficient to obtain a pulp therefrom;

(f) retaining the pulp in a high consistency tower for a time sufficient to allow chemical reactions to complete; and thereafter (g) transferring the pulp from the high consistency tower to downstream processes and recovering the pulp therefrom.

2. The process of claim 1, wherein substantially all the alkali peroxide chemicals are added immediately before the fiberized lignocellulosic material is transferred to the refiner.

3. The process of claim 2, comprising washing the fiberized lignocellulosic material with a press.

4. The process of claim 1, wherein step (a) is practiced at a pressure of between 0 to 10 bar, a temperature of between 10 to 170° C., and for a time of between 0.1 to 7 hours.

5. The process of claim 4, further comprising adding liquor to the lignocellulosic chip material so as to achieve the liquor to wood ratio.

6. The process of claim 1, wherein the pulp discharged from the high consistency tower has a pulp consistency between about 12 to about 60%.

7. The process of claim 6, wherein the pulp consistency is between about 15 to about 45%.

8. The process of claim 1, which comprises subjecting the pulp to a temperature condition within the high consistency tower of between about 20 to about 100° C. and retaining the pulp within the high consistency tower for between about 15 minutes to about 4 hours.

* * * * *